US011781328B2

(12) United States Patent
Morijiri et al.

(10) Patent No.: US 11,781,328 B2
(45) Date of Patent: Oct. 10, 2023

(54) BINDING MACHINE

(71) Applicant: MAX CO., LTD., Tokyo (JP)

(72) Inventors: Takeshi Morijiri, Tokyo (JP); Nobutaka Tashima, Tokyo (JP); Shinpei Sugihara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/273,932

(22) PCT Filed: Sep. 5, 2019

(86) PCT No.: PCT/JP2019/035089
§ 371 (c)(1),
(2) Date: Mar. 5, 2021

(87) PCT Pub. No.: WO2020/050385
PCT Pub. Date: Mar. 12, 2020

(65) Prior Publication Data

US 2021/0396028 A1 Dec. 23, 2021

(30) Foreign Application Priority Data

Sep. 7, 2018 (JP) ..... 2018-168250
Aug. 28, 2019 (JP) ..... 2019-156059

(51) Int. Cl.
*E04G 21/12* (2006.01)
*B21F 15/04* (2006.01)
*B25B 25/00* (2006.01)

(52) U.S. Cl.
CPC ..... *E04G 21/123* (2013.01); *B21F 15/04* (2013.01); *B25B 25/00* (2013.01)

(58) Field of Classification Search
CPC ..... E04G 21/123; E04G 21/122; B21F 15/04; B21F 15/02; B21F 9/02; B21F 7/00;
(Continued)

(56) References Cited

U.S. PATENT DOCUMENTS 5,323,816 A * 6/1994 Hoyaukin ..... E04G 21/122 140/57
6,401,766 B1 6/2002 Ishikawa et al.
(Continued)

FOREIGN PATENT DOCUMENTS

CN 105625727 A 6/2016
CN 205577437 U 9/2016
(Continued)

OTHER PUBLICATIONS

Translation of JP-07290177-A (Year: 1995).*
(Continued)

*Primary Examiner* — Katrina M Stransky
*Assistant Examiner* — Teresa A Guthrie
(74) *Attorney, Agent, or Firm* — WEIHROUCH IP

(57) ABSTRACT

A binding machine includes: a first body part; a second body part having a curl guide and a twisting shaft that holds and twists the curled wire; and an elongated connecting part connecting the first body part and the second body part. The curl guide includes a first guide part and a second guide part projecting in a first direction from the tip end of the second body part and disposed with a prescribed gap therebetween in a second direction orthogonal to the first direction. The first body part and the second body part are disposed such that a virtual axis line is inclined toward the axis line of the twisting shaft, the virtual axis line connecting an intermediate position in the prescribed gap and an intermediate position in the lateral direction of the connecting part at the connection end of the connecting part with the first body part.

13 Claims, 14 Drawing Sheets

(58) Field of Classification Search
CPC ..... B25B 25/00; B65B 13/28; B65B 13/285; B65B 13/24; B65B 13/18
USPC ..... 140/93.6
See application file for complete search history.

(56) References Cited

U.S. PATENT DOCUMENTS

| | | | | |
|---|---|---|---|---|
| 6,668,870 | B2 * | 12/2003 | Rossum | B21F 15/04 140/118 |
| 8,561,717 | B2 * | 10/2013 | Pozgay | B25B 21/00 173/217 |
| 11,365,552 | B2 | 6/2022 | Morijiri et al. | |
| 2006/0157139 | A1 | 7/2006 | Hoyaukin | |
| 2017/0218631 | A1 * | 8/2017 | Matsuno | B21F 15/04 |
| 2019/0194959 | A1 * | 6/2019 | Shima | B21F 15/04 |

FOREIGN PATENT DOCUMENTS

| | | | | | |
|---|---|---|---|---|---|
| CN | 206607821 | U | | 11/2017 | |
| JP | S48-021284 | Y | | 6/1973 | |
| JP | 07290177 | A | * | 11/1995 | E04G 21/123 |
| JP | H07-290177 | A | | 11/1995 | |
| JP | 2001-038647 | A | | 2/2001 | |
| JP | 2006-520865 | A | | 9/2006 | |
| JP | 2017-189822 | A | | 10/2017 | |
| JP | 2009-275487 | A | | 11/2019 | |

OTHER PUBLICATIONS

International Search Report and Written Opinion issued in Application No. PCT/JP2019/035089 dated Nov. 26, 2019, 15 pages.
Extended European Search Report for EP Application No. 19857856.9 dated Apr. 8, 2022. (8 pp.).

* cited by examiner

BINDING MACHINE

CROSS REFERENCE TO RELATED APPLICATION

This application is a 35 U.S.C. 371 National Phase Entry Application from PCT/JP2019/035089, filed Sep. 5, 2019, which claims priority to Japanese Patent Application Nos. 2018-168250, filed Sep. 7, 2018, and 2019-156059, filed Aug. 28, 2019, the disclosures of which are incorporated herein in their entirety by reference, and priority is claimed to each of the foregoing.

TECHNICAL FIELD

The present disclosure relates to a binding machine configured to bind a binding object such as a reinforcing bar and the like with a wire.

BACKGROUND ART

In the related art, a binding machine referred to as a reinforcing bar binding machine configured to wind a wire curled by a curl guide around a binding object such as a plurality of reinforcing bars or iron pipes, etc. (hereinbelow, referred to as "reinforcing bars and the like") and to twist the wound wire to bind the reinforcing bars and the like by a wire twisting device. In particular, a relatively small binding machine that can be easily operated with one hand and is conveniently carried and stored is recently spread (for example, refer to PTL 1).

However, when binding the reinforcing bars and the like arranged on a floor surface by using the small binding machine, for example, an operator should largely bend at the waist or knees for an operation. In contrast, PTL 2 discloses a binding machine including a casing having a twisting mechanism configured to twist leg portions of a wire loop surrounding reinforcing bars and the like to bind the reinforcing bars and the like, a handle, and a telescopic part configured to connect the casing and the handle and capable of adjusting a length thereof. According to the binding machine, since an entire length of the binding machine can be increased by extending the telescopic part, an operator can perform a binding operation without largely bending at the waist or knees, unlike the related art.

PTL 1: JP 2009-275487 A

PTL 2: JP 2006-520865 A

SUMMARY OF INVENTION

By extending the entire length of the binding machine, the operator can perform a binding operation without largely bending at the waist or knees. However, even though the entire length is extended, when the operator intends to bind the reinforcing bars and the like at a position distant from a foot of the operator (for example, a position ahead of the foot), for example, the operator should tilt the binding machine toward the reinforcing bars and the like. As a result, the reinforcing bars and the like are bound in an oblique direction by the binding machine. In order to securely bind the reinforcing bars and the like by increasing a binding force, it is preferable to perform the binding operation in a direction (immediately above) close to a vertical direction to the reinforcing bars and the like. However, when the reinforcing bars and the like are bound in the oblique direction, the binding force is lowered.

In response to the above issue, it is an object of the present disclosure to provide a binding machine capable of binding reinforcing bars and the like arranged on a floor surface without largely bending at the waist or knees, and securely binding reinforcing bars and the like at a position distant from a foot of an operator without lowering a binding force.

A binding machine according to one aspect of the present disclosure includes a first body part, a second body part, and an elongated connecting part connecting the first body part and the second body part. The second body part has a housing, a curl guide attached to the housing, and a twisting unit arranged in the housing, the curl guide has an opening into which a binding object can be inserted and is configured to curl a wire around the binding object inserted in the opening, and the twisting unit includes a twisting shaft for twisting the curled wire. The first body part and the second body part are connected by the elongated connecting part, so that an entire length of the binding machine increases. Therefore, for example, an operator can bind reinforcing bars and the like arranged on a floor surface without largely bending at the waist or knees.

The curl guide includes first and second guide parts projecting in a first direction from a tip end of the housing and arranged with a prescribed gap to define the opening in a second direction orthogonal to the first direction. The first body part and the second body part are arranged such that a virtual axis line, which connects an intermediate position in the prescribed gap at a tip end of the second body part and an intermediate position in a lateral direction of the connecting part at a connection end of the connecting part with the first body part, is inclined relative to an axis line of the twisting shaft. The virtual axis line is inclined relative to the axis line of the twisting shaft, so that when binding the binding object at a position distant from a foot of an operator (for example, a position ahead of the foot), the twisting shaft of the second body part can be positioned vertically or substantially vertically with respect to the binding object.

In the binding machine according to the one aspect of the present disclosure, since the first body part and the second body part are connected by the elongated connecting part, the binding object arranged on the floor surface can be bound without largely bending at the waist or knees. Since the virtual axis line is inclined relative to the axis line of the twisting shaft, the twisting shaft of the second body part can be positioned vertically or substantially vertically with respect to the binding object at a position distant from the foot of the operator. Thereby, it is possible to securely bind the binding object at a position distant from the foot of the operator without lowering the binding force.

DESCRIPTION OF EMBODIMENTS

Hereinbelow, preferred embodiments of the present disclosure will be described with reference to the drawings.

First Embodiment

Figure 1:
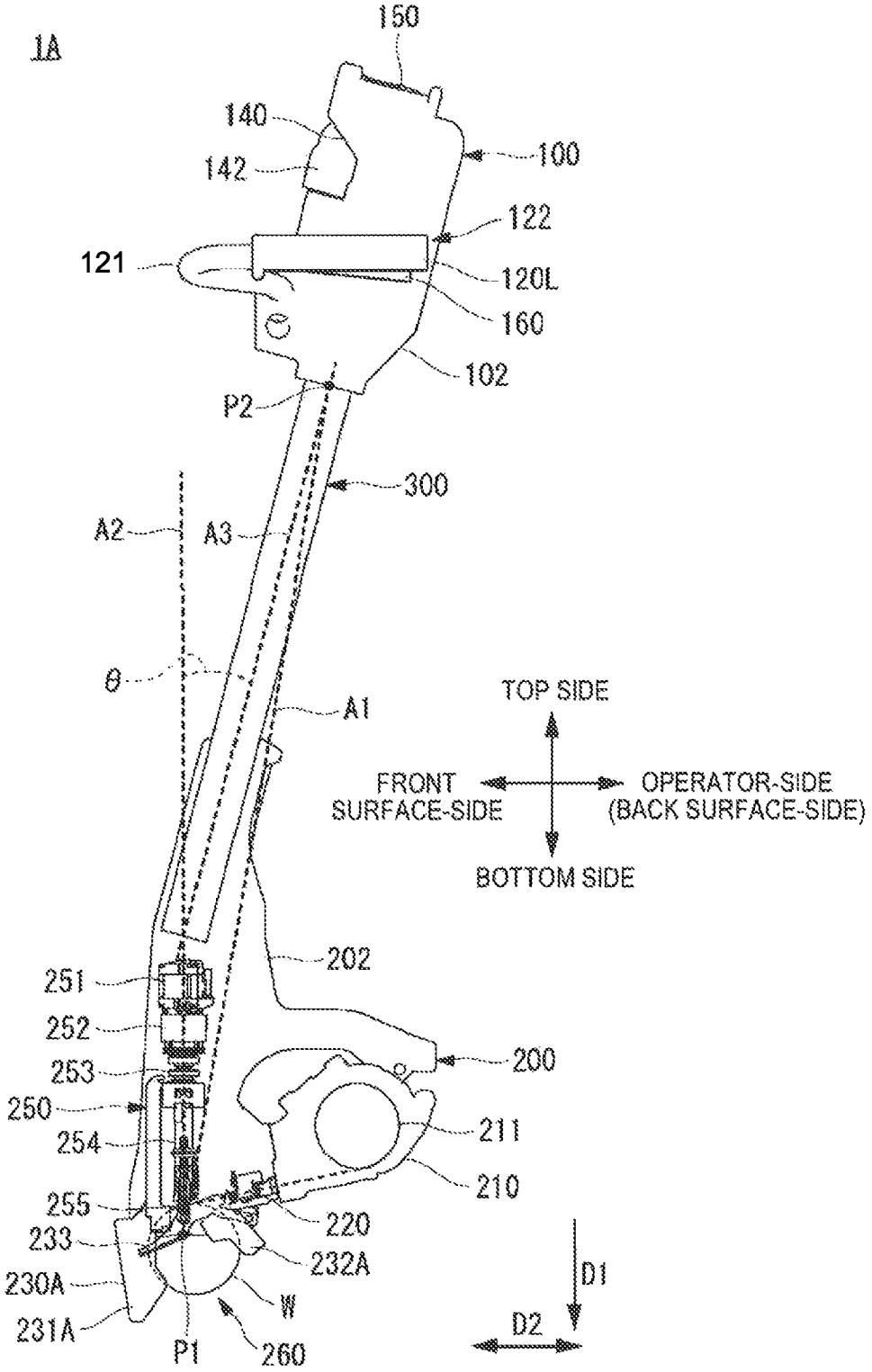
FIG. 1 is a side view depicting an internal configuration of a reinforcing bar binding machine of a first embodiment.
Figure 2:
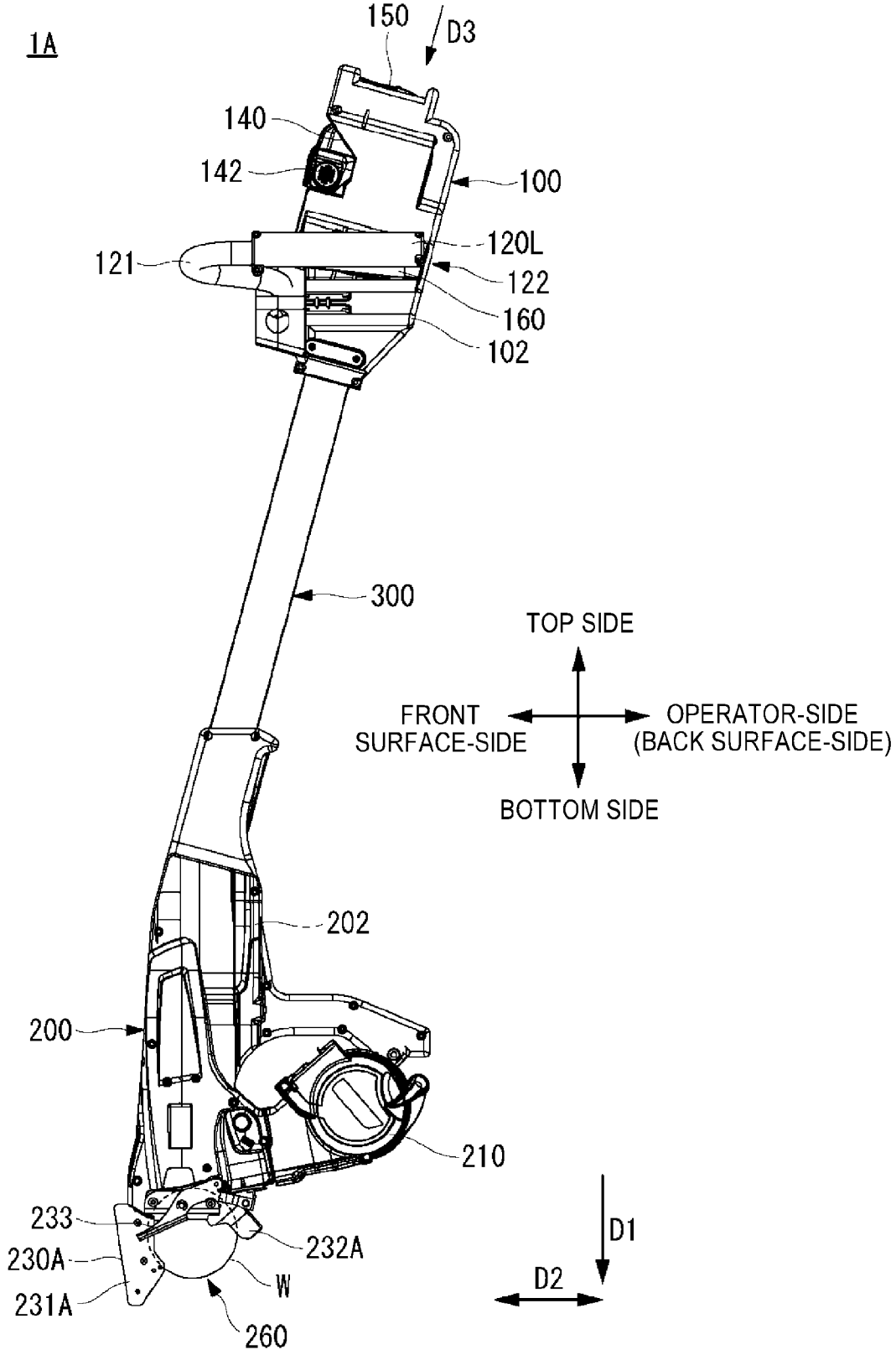
FIG. 2 is a side view depicting an external configuration of the reinforcing bar binding machine of the first embodiment.
Figure 4:
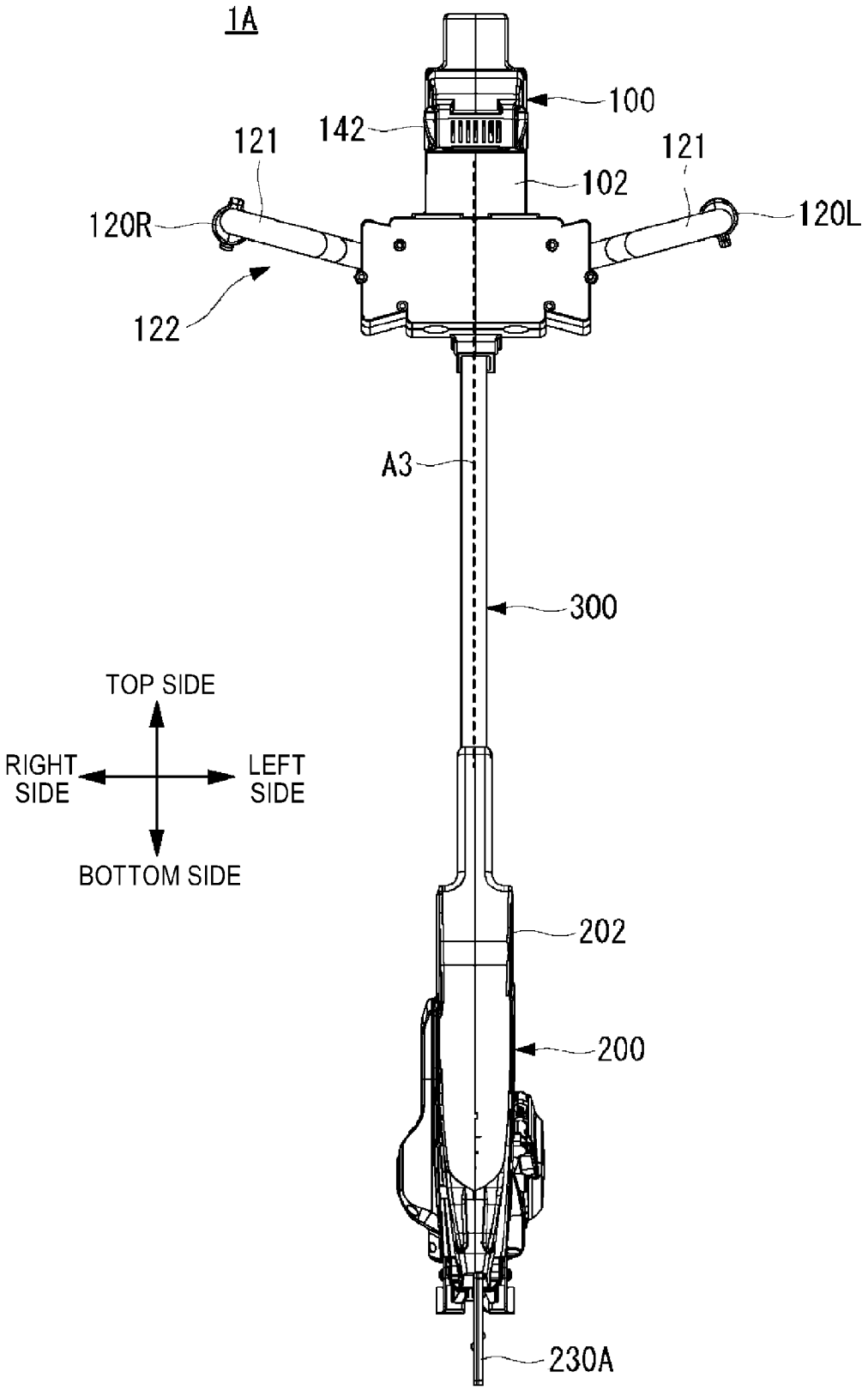
FIG. 4 is a front view depicting the external configuration of the reinforcing bar binding machine of the first embodiment.
Figure 5:
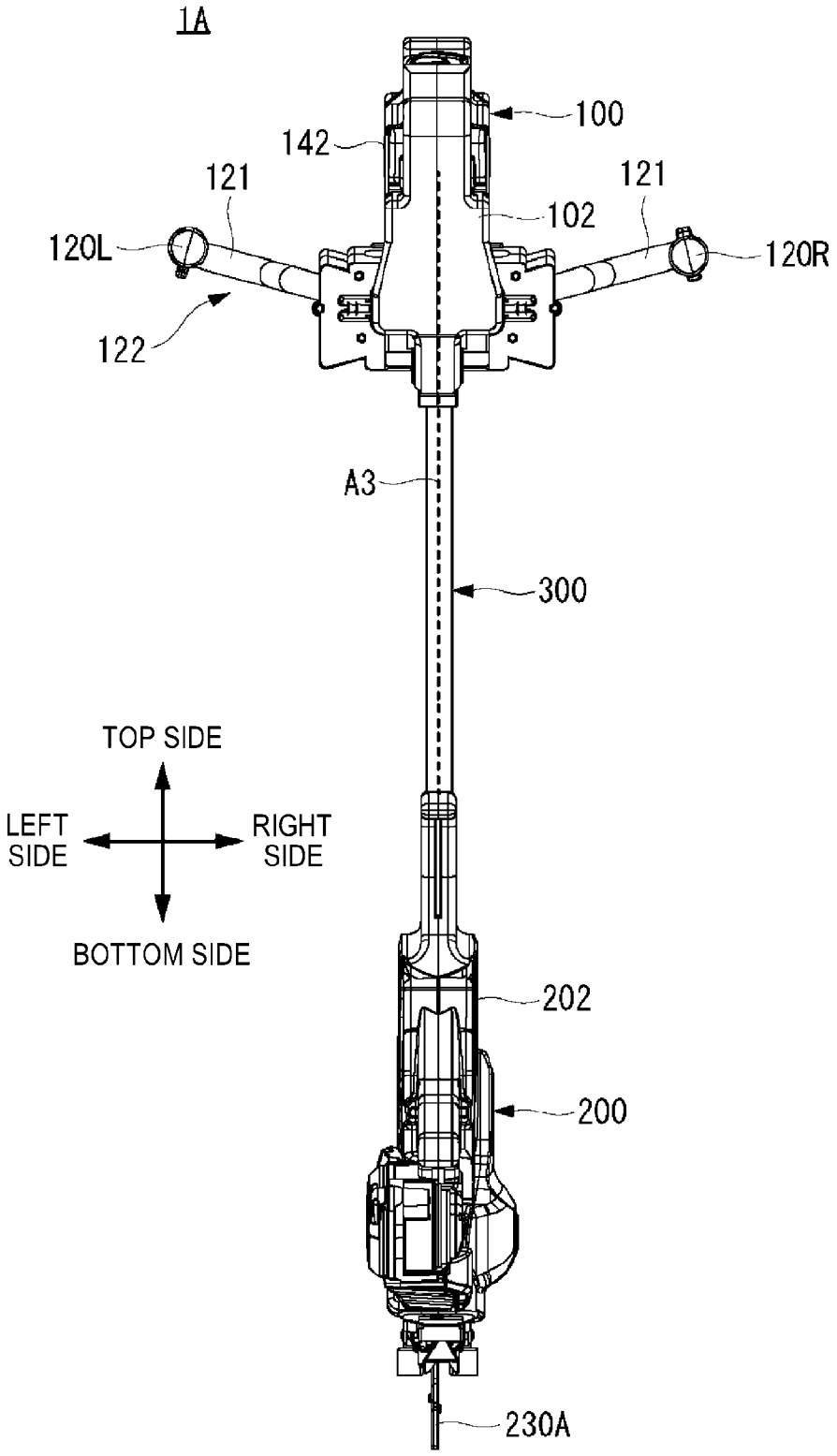
FIG. 5 is a rear view depicting the external configuration of the reinforcing bar binding machine of the first embodiment.
Figure 6:
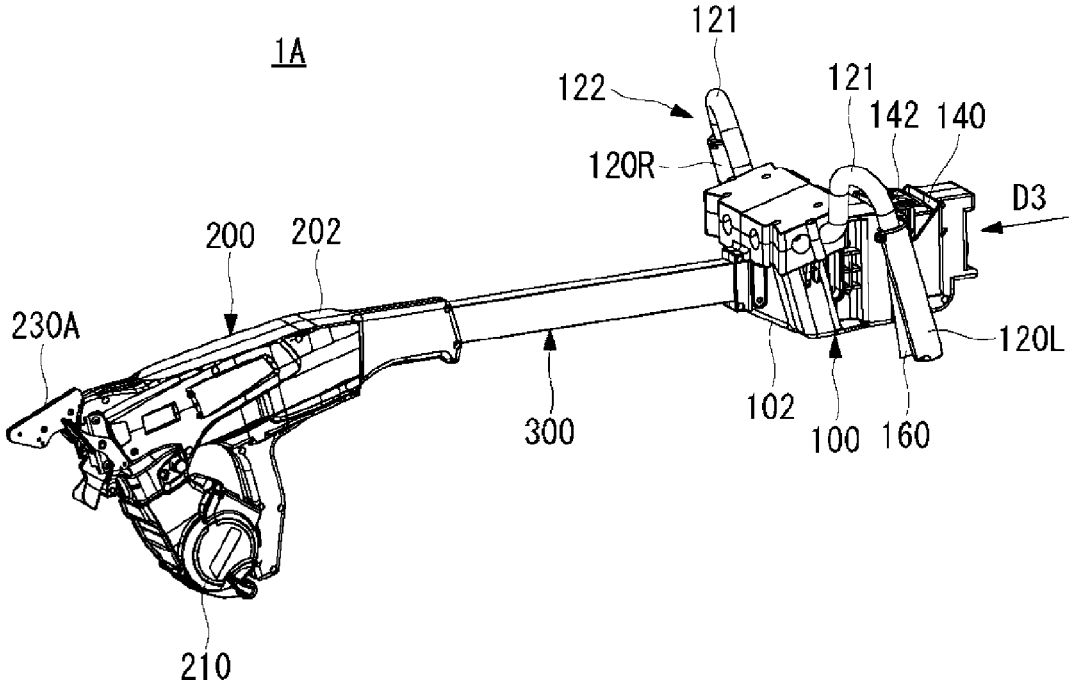
FIG. 6 is a perspective view depicting the external configuration of the reinforcing bar binding machine of the first embodiment.
Figure 7:
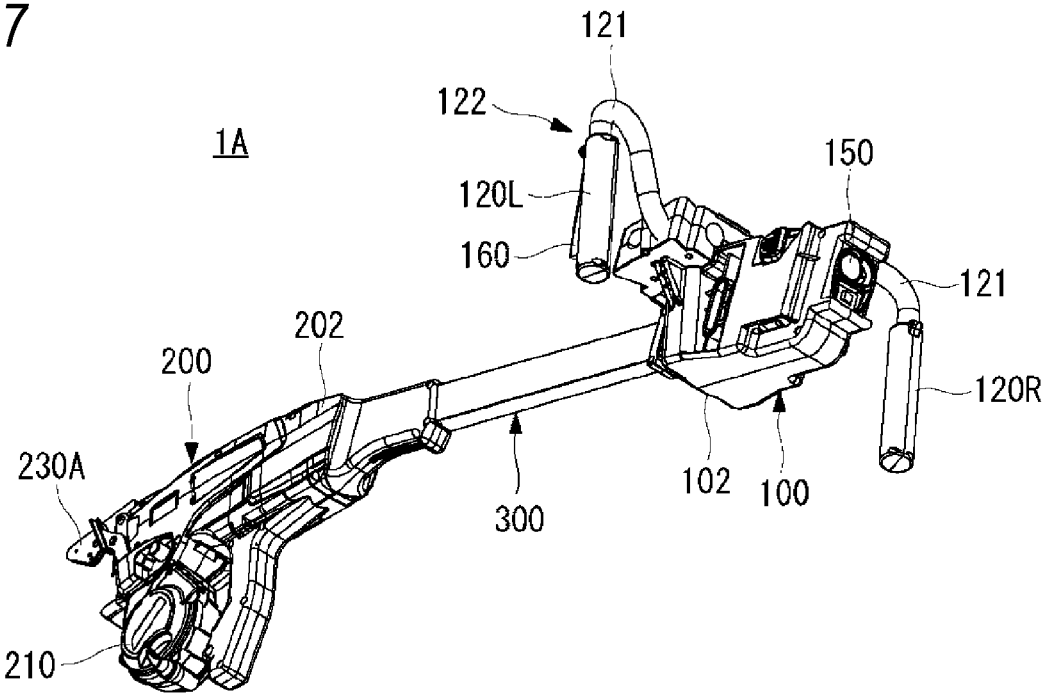
FIG. 7 is a perspective view depicting the external configuration of the reinforcing bar binding machine of the first embodiment.

FIG. 1 is a side view depicting an internal configuration of a reinforcing bar binding machine 1A of a first embodiment, and FIG. 2 is a side view depicting an external configuration of the reinforcing bar binding machine 1A. FIG. 4 is a front view depicting the external configuration of the reinforcing bar binding machine 1A, FIG. 5 is a rear view, and FIGS. 6 and 7 are perspective views.

[Configuration Example of Reinforcing Bar Binding Machine 1A]

A reinforcing bar binding machine 1A includes a first body part 100 having a handle part 122 including a pair of grips 120R and 120L that can be grasped by an operator, a second body part 200 having a curl guide 230A configured to curl a wire W around a binding object and a twisting unit 250 configured to hold and twist the wire W curled by the curl guide 230A, and an elongated connecting part 300 configured to connect the first body part 100 and the second body part 200 each other.

In the first embodiment, a side on which the curl guide 230A is provided is referred to a tip end-side or a bottom side of the reinforcing bar binding machine 1A, and an opposite side, i.e., an end portion-side of the first body part 100 is referred to as a base end-side or a top side of the reinforcing bar binding machine 1A. Sides which are orthogonal to a vertical direction of the reinforcing bar binding machine 1A and on which the grips 120R and 120L are positioned are referred to as sides of the reinforcing bar binding machine 1A, and the grip 120R-side is referred to as a right side of the reinforcing bar binding machine 1A and the grip 120L-side is referred to as a left side of the reinforcing bar binding machine 1A. A side which is orthogonal to the vertical direction and the right and left direction of the reinforcing bar binding machine 1A and on which an operator who grasps the grips 120R and 120L stands is referred to as an operator-side or a back surface-side of the reinforcing bar binding machine 1A, and an opposite side is referred to as a front surface-side of the reinforcing bar binding machine 1A.

The first body part 100 has a first housing 102, a handle part 122 attached to the first housing 102 and having the pair of grips 120R and 120L, and a battery mounting part 140 provided to the first housing 102 and configured to mount a battery 142. A tip end-side of the first housing 102 is connected to the connecting part 300, and a base end-side thereof is provided with a setting unit 150 for setting a variety of operation conditions of the reinforcing bar binding machine 1A.

As shown in FIGS. 6 and 7, the handle part 122 is constituted by a U-shaped or M-shaped long member, as seen in an axis line direction D3 of the connecting part 300, and has the grips 120R and 120L on both ends thereof. A grip connecting part 121 is provided between the grips 120R and 120L and is attached to the first housing 102. At least one of the grips 120R and 120L is provided with an operation switch 160 (refer to FIG. 1) for starting a binding operation. Note that, the handle part 122 may have diverse shapes, such as a linear shape as seen in the axis line direction D3 of the connecting part 300 and a U-shape or M-shape as seen in the front surface or back surface direction.

As shown in FIGS. 4 and 5, the grips 120R and 120L are provided on respective both sides of an axis line A3 of the connecting part 300 or an extension line of the axis line A3, as seen from the operator-side, when the operator grasps and operates the grips 120R and 120L. The grip 120R is arranged on the right side of the axis line A3, as seen from the operator-side, and the grip 120L is arranged on the left side of the axis line A3, as seen from the operator-side.

The battery mounting part 140 is provided to the first housing 102 so as to be positioned above the handle part 122. The battery mounting part 140 is arranged on the extension line of the axis line A3 of the connecting part 300.

The setting unit 150 is a unit for adjusting the number of turns of the wire W, the twisting torque for the wire W, and the like, and is constituted by a dial-type or push-type switch, for example.

As shown in FIG. 1, the second body part 200 has a second housing (housing) 202, a reel accommodation part 210 configured to accommodate a wire reel 211 on which the wire W is wound, a wire feeding unit 220 configured to reel out and feed the wire W from the wire reel 211 accommodated in the reel accommodation part 210, a curl guide 230A configured to curl the wire W around the binding object, a cutting unit (not shown) configured to cut the wire W curled by the curl guide 230A, and a twisting unit 250 configured to hold and twist the wire W curled by the curl guide 230A and cut by the cutting unit. The curl guide 230A is provided at a tip end portion of the second housing 202, and the wire feeding unit 220, the cutting unit and the twisting unit 250 are accommodated in the second housing 202.

The wire feeding unit 220 is provided between the reel accommodation part 210 and the curl guide 230A, and has a pair of feeding gears for feeding the wire. The pair of feeding gears of the wire feeding unit 220 is configured to rotate in forward and reverse directions by drive of a motor (not shown). Thereby, when the feeding gears are rotated in the forward direction, the wire W can be fed toward the curl guide 230A, and when the feeding gears is rotated in the reverse direction, the wire W can be pulled back toward the reel accommodation part 210.

The curl guide 230A has an opening 260 in which reinforcing bars S can be inserted, and is configured to curl the wire W around the reinforcing bars S inserted in the opening 260. The curl guide 230A is provided projecting further forward (in the first direction D1) from the tip end portion of the second housing 202, and is constituted by a pair of guide parts, i.e., a first guide part 231A and a second guide part 232A. The first guide part 231A and the second guide part 232A are arranged with a prescribed gap L to define the opening 260 in a second direction D2 orthogonal to the first direction D1. The first guide part 231A is configured to regulate an advancing direction of the wire W fed from the wire feeding unit 220 and to curl the wire W. The second guide part 232A is configured to receive the wire W curled by the first guide part 231A and to guide the wire to the twisting unit 250. When binding the reinforcing bars S, the reinforcing bars S are inserted into the opening 260 between the first guide part 231A and the second guide part 232A.

A cover part 206 configured to cover a tip end-side end portion of the second housing 202 and a contact member 233 configured to move the second guide part 232A as the reinforcing bars S are contacted thereto are provided on a tip end-side of the second housing 202 and between the first guide part 231A and the second guide part 232A.

Figure 3A:
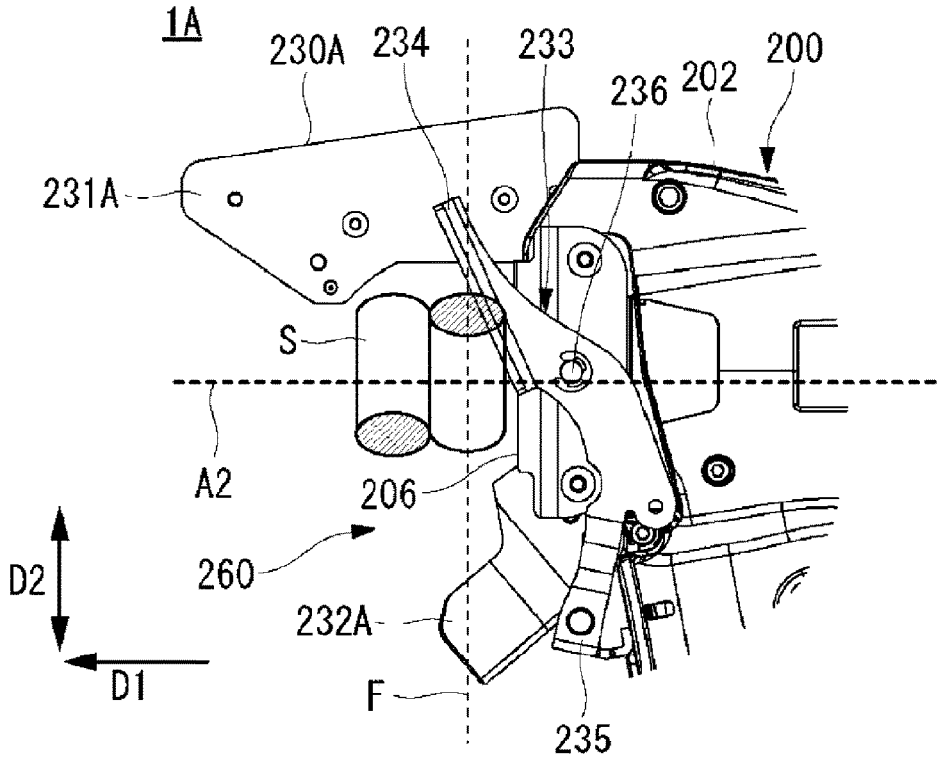
FIG. 3A is a side view depicting an example of a configuration of main parts of a second body part.
Figure 3B:
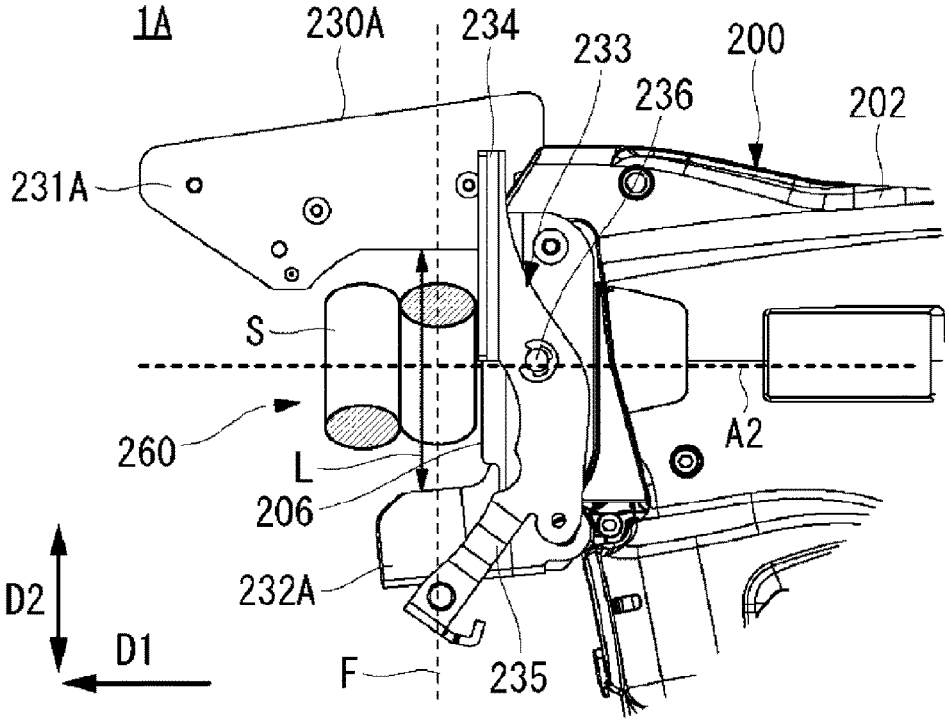
FIG. 3B is a side view depicting an example of a configuration of main parts of the second body part.

As shown in FIGS. 3A and 3B, the cover part 206 is constituted by a metal plate member, and is attached to cover an end portion on a bottom side of the second housing 202 between a base end-side of the first guide part 231A and a base end-side of the second guide part 232A.

The contact member 233 is rotatably supported by a shaft 236 attached to the cover part 206. The contact member 233 is a dog leg-shaped member, and has a pair of contact parts 234 (only one contact part is shown in FIG. 3A and the like) extending toward the first guide part 231A and a pressing part 235 extending toward the second guide part 232A with the shaft 236 being interposed therebetween.

The contact parts 234 are arranged at positions at which the reinforcing bars S inserted in the opening 260 can contact, and the pressing part 235 is in contact with the second guide part 232A. When the contact parts 234 are pressed to the reinforcing bars S and are thus moved in an opposite direction to the first direction D1, the contact member 233 rotates about the shaft 236 as a support point. When the contact member 233 rotates as the contact parts 234 are pressed to the reinforcing bars S, the pressing part 235 pushes the second guide part 232A toward the first guide part 231A. Thereby, the second guide part 232A moves from an open position opened with respect to the first guide part 231A to a closed position. In this way, since the second guide part 232A is open with respect to the first guide part 231A until the reinforcing bars S are contacted to the contact parts 234, the reinforcing bars S can be easily inserted into the opening 260 of the curl guide 230A. In particular, in the reinforcing bar binding machine 1A having a long entire length, like the first embodiment, since a binding position is distant from the operator, it is difficult to insert the reinforcing bars S. For this reason, when the second guide part 232A is open during the binding, the reinforcing bars S can be easily inserted into the opening 260 of the curl guide 230A.

The twisting unit 250 includes a twisting motor 251, a deceleration mechanism 252 configured to perform deceleration and torque amplification of the twisting motor 251, a twisting shaft 253 connected to the deceleration mechanism 252 and configured to rotate by rotation of the twisting motor 251, a movable member 254 configured to be displaced by a rotating operation of the twisting shaft 253, and a holding part 255 projecting from a tip end-side of the movable member 254 and configured to hold and twist the wire W.

An outer peripheral surface of the twisting shaft 253 and an inner peripheral surface of the movable member 254 are each formed with screws, so that the screw of the twisting shaft 253 is in mesh with the screw of the movable member 254. When the twisting shaft 253 rotates in a state where rotation of the movable member 254 is regulated, the movable member 254 moves in the front and rear direction, and when the regulation of rotation is released, the movable member rotates integrally with the twisting shaft 253.

The holding part 255 has a plurality of claw portions for holding the wire W. The holding part 255 opens and closes as the movable member 254 moves in the front and rear direction, and rotates as the movable member 254 rotates.

The connecting part 300 is an elongated hollow member and has a wiring laid therein. The connecting part 300 is constituted by a rod-shaped member thinner than diameters of the first body part 100 and the second body part 200. A length of the connecting part 300 is selected depending on an average height and the like of the operator, for example. For the connecting part 300, for example, metal such as aluminum and stainless steel and non-metal such as resin, carbon fiber and the like can be used. Thereby, it is possible to reduce an entire weight of the reinforcing bar binding machine 1A.

A base end-side (upper end portion) of the connecting part 300 is attached to the first housing 102, and a tip end-side (lower end portion) of the connecting part 300 is attached to the second housing 202. The connecting part 300 can be configured so that it is detachably attached to the first body part 100 and the second body part 200.

The wiring laid in the connecting part 300 is connected to the battery 142 and the operation switch 160 of the first body part 100 and a control device and the like of the second body part 200. Thereby, communication of electric signals can be performed between the first body part 100 and the second body part 200, and power can be supplied from the first body part 100 to the second body part 200.

[Arrangement Relation of Second Body Part 200 and Connecting Part 300, etc.]

In the reinforcing bar binding machine 1A of the present embodiment, a following configuration is adopted so that, when binding the reinforcing bars S arranged on a floor surface, a reinforcing bar arrangement plane F of the reinforcing bars S arranged substantially parallel to the floor surface so as to follow the floor surface is orthogonal or substantially orthogonal to an axis line A2 of the twisting shaft 253 of the second body part 200.

As shown in FIGS. 1 and 2, the connecting part 300 and the first body part 100 are arranged inclined toward the operator with respect to the second body part 200, as seen from a side of the reinforcing bar binding machine 1A. Specifically, as shown in FIG. 1, the first body part and the second body part are arranged so that a virtual axis line A1, which connects an intermediate position P1 at a tip end of the second body part 200 and between the first guide part 231A and the second guide part 232A and an intermediate position P2 at a connection end of the connecting part 300 with the first body part 100 and in a lateral direction of the connecting part 300, is inclined relative to the axis line A2 of the twisting shaft 253 of the twisting unit 250. The virtual axis line A1 is inclined toward the operator with respect to the axis line A2 of the twisting shaft 253 in a state where the operator grasps the grip 120R and the grip 120L.

In the present embodiment, the connecting part 300 is attached to the second body part 200 so that the axis line A3 of the connecting part 300 is inclined toward the operator with respect to the axis line A2 of the twisting shaft 253. In the first embodiment, an inclination angle θ of the axis line A3 of the connecting part 300 relative to the axis line A2 of the twisting shaft 253 is 15 degrees. However, the inclination angle θ is appropriately set depending on situations such as a body characteristic of the operator and a scaffold in an operation site, and is not limited to 15 degrees. However, the inclination angle θ is preferably set to 45 degrees or smaller. When the inclination angle θ exceeds 45 degrees, a center of gravity of the reinforcing bar binding machine 1A is distant from the operator, so that a weight balance of the reinforcing bar binding machine 1A is greatly disturbed.

The connecting part 300 can be configured to change the inclination angle θ relative to the second body part 200. As a mechanism for changing the inclination angle θ, for example, a configuration using a fastening means such as a screw and a bolt, a configuration using a rotating means such as a hinge and other well-known means can be adopted as appropriate. The inclination angle θ can be arbitrarily adjusted within a range from an angle larger than 0° to 45° by the operator. In addition, an operation unit and a drive unit may be provided and the inclination angle θ of the connecting part 300 may be electrically changed.

[Example of Operation of Reinforcing Bar Binding Machine 1A]

In the reinforcing bar binding machine 1A, the virtual axis line A1 is inclined toward the operator with respect to the axis line A2 of the twisting shaft 253. Particularly, in the first embodiment, the axis line A3 of the connecting part 300 is inclined toward the operator with respect to the axis line A2 of the twisting shaft 253. Therefore, when binding the reinforcing bars S distant from the foot of the operator, for example, ahead of the foot, the operator can position the twisting shaft 253 vertically or substantially vertically with respect to the reinforcing bars S within a range in which the curl guide of the reinforcing bar binding machine 1A can be contacted, even though the operator does not move intentionally to the vicinity of the reinforcing bars S. Therefore, the operator can securely bind the surrounding reinforcing bars S without changing the standing position.

When binding the reinforcing bars S, the operator inserts the reinforcing bars S into the opening 260 between the first guide part 231A and the second guide part 232A, and presses the reinforcing bars S to the contact parts 234 of the contact member 233. Accordingly, the contact member 233 rotates about the shaft 236 as a support point, so that the second guide part 232A is pushed by the pressing part 235 and is moved from the open position to the closed position. The operator turns on the operation switch 160 in a state where the second guide part 232A is closed, so that a binding operation starts.

When the operation switch 160 is turned on, the pair of feeding gears of the wire feeding unit 220 rotates with sandwiching the wire W, thereby delivering the wire W from the wire reel 211 toward the curl guide 230A. The wire W fed by the wire feeding unit 220 is curled by the curl guide 230A, and the curled wire W is then wound several times around the reinforcing bars S. The number of winding times (number of turns) of the wire W around the reinforcing bars S can be set by the setting unit 150. The wire W wound several times on the reinforcing bars S is cut by the cutting unit and is then twisted by the twisting unit 250. By the above operations, the reinforcing bars S can be bound with the wire W.

[Effects of First Embodiment]

According to the first embodiment, since the virtual axis line A1 is inclined relative to the axis line A2 of the twisting shaft 253, the twisting shaft 253 can be positioned orthogonal or substantially orthogonal to (reinforcing bar arrangement plane F of) the reinforcing bars S when binding the reinforcing bars S ahead of the foot. Thereby, it is possible to bind the reinforcing bars S without lowering the binding force.

Also, according to the first embodiment, since the inclination angle θ of the connecting part 300 relative to the second body part 200 can be changed, it is possible to optimally adjust the inclination angle θ of the connecting part 300 relative to the second body part 200 depending on situations such as a height of the operator and a scaffold in an operation site.

<Modified Embodiments of First Embodiment>

Note that, in the reinforcing bar binding machine 1A of the first embodiment, the binding operation is enabled to start by turning on the operation switch 160. However, the present disclosure is not limited thereto. For example, instead of the configuration where the binding operation is enabled to start by turning on the operation switch 160, the binding operation may be enabled to start when it is detected that the reinforcing bars S are contacted to the contact member 233. In this case, the operability is improved because it is not necessary to turn on the operation switch 160 when binding the reinforcing bars S.

In addition, instead of the configuration where the binding operation is enabled to start when the reinforcing bars S are contacted to the contact member 233, the binding operation may be enabled to start when the reinforcing bars S are contacted to the contact member 233 in a state where the operation switch 160 is turned on. In this case, in the state where the operation switch 160 is turned on, the reinforcing bars S can be bound in succession, so that the operability is improved. Further, when the operation switch 160 is not turned on, the binding operation does not start even though the reinforcing bars S are contacted to the contact member, so that a careless binding operation can be suppressed from being executed. Note that, as a specific structure of the modified embodiment, for example, an actuation switch that is switched between on and off states according to the rotating operation of the contact member 233 may be arranged in the vicinity of the contact member 233, and when the actuation switch becomes on, the binding operation may be executed. Examples of the actuation switch include a mechanical switch and a sensor such as a Hall IC.

When binding the reinforcing bars S, the operator inserts the reinforcing bars S into the opening 260 between the first guide part 231A and the second guide part 232A in a state where the operation switch 160 is turned on. Thereby, when the reinforcing bars S are pressed to the contact parts 234 of the contact member 233 and the contact member 233 rotates about the shaft 236 as a support point and moves to an operation position, for example, a second switch becomes on. A control unit (not shown) provided in the second body part 200 starts the binding operation when both the operation switch 160 and the actuation switch are on. The second guide part 232A is moved from the open position to the closed position by the rotation of the contact member 233.

Second Embodiment

Figure 8:
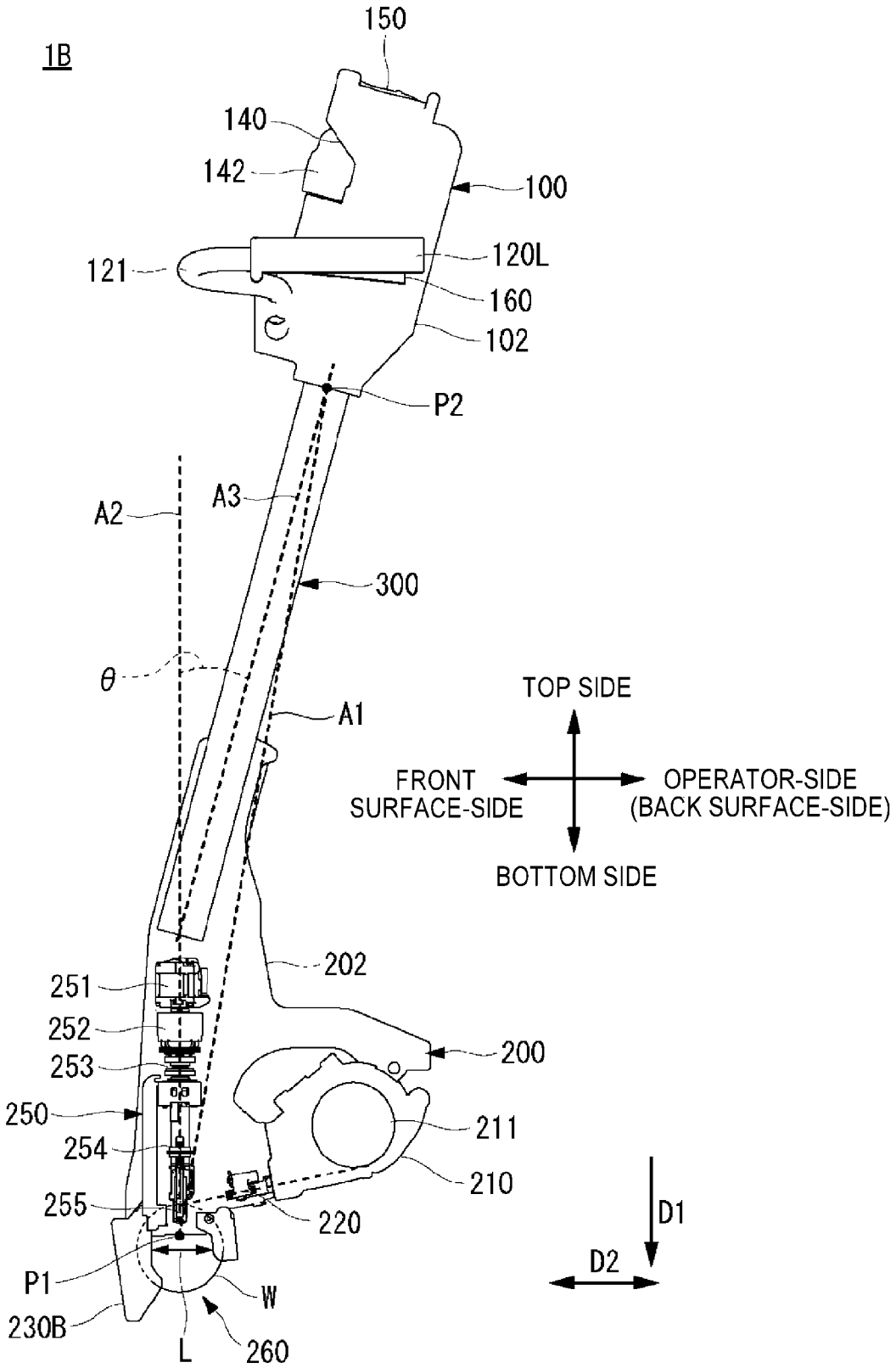
FIG. 8 is a side view depicting an internal configuration of a reinforcing bar binding machine of a second embodiment.

FIG. 8 is a side view depicting an internal configuration of a reinforcing bar binding machine 1B of a second embodiment. The reinforcing bar binding machine 1B of the second embodiment is different from the reinforcing bar binding machine 1A of the first embodiment, in that the contact member 233 is not provided. Since the reinforcing bar binding machine 1B is not provided with the contact member 233, the curl guide 230B is not opened and closed even when the reinforcing bars S are inserted and pulled out with respect to the opening 260. Note that, the reinforcing bar binding machine 1B has a similar configuration to the reinforcing bar binding machine 1A, except that the contact member 233 is not provided.

Third Embodiment

A reinforcing bar binding machine 1C of a third embodiment is different from the reinforcing bar binding machine 1A of the first embodiment, in that a second body part 200C is provided with a second fixing mechanism 270, a part of the second body part 200C is configured to be opened/closed, and a first body part 100C is provided with a first fixing mechanism 170. Therefore, in the below, as for the reinforcing bar binding machine 1C of the third embodiment, the constitutional elements that are substantially common to the reinforcing bar binding machine 1A of the first embodiment described with reference to FIGS. 1 to 9 are denoted with the same reference signs, and the different constitutional elements are specifically described.

Figure 9:
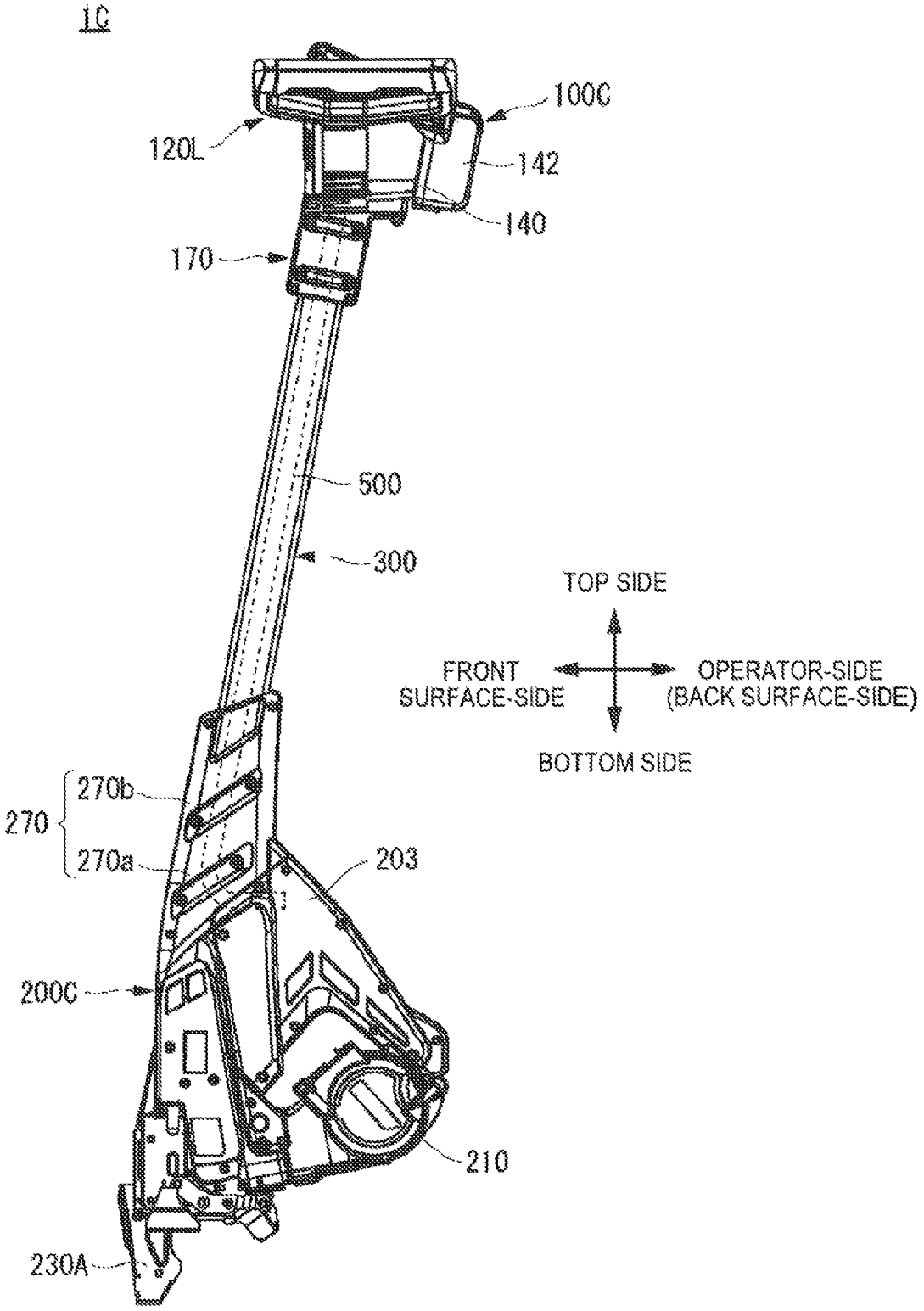
FIG. 9 is a side view depicting an external configuration of a reinforcing bar binding machine of a third embodiment.
Figure 10:
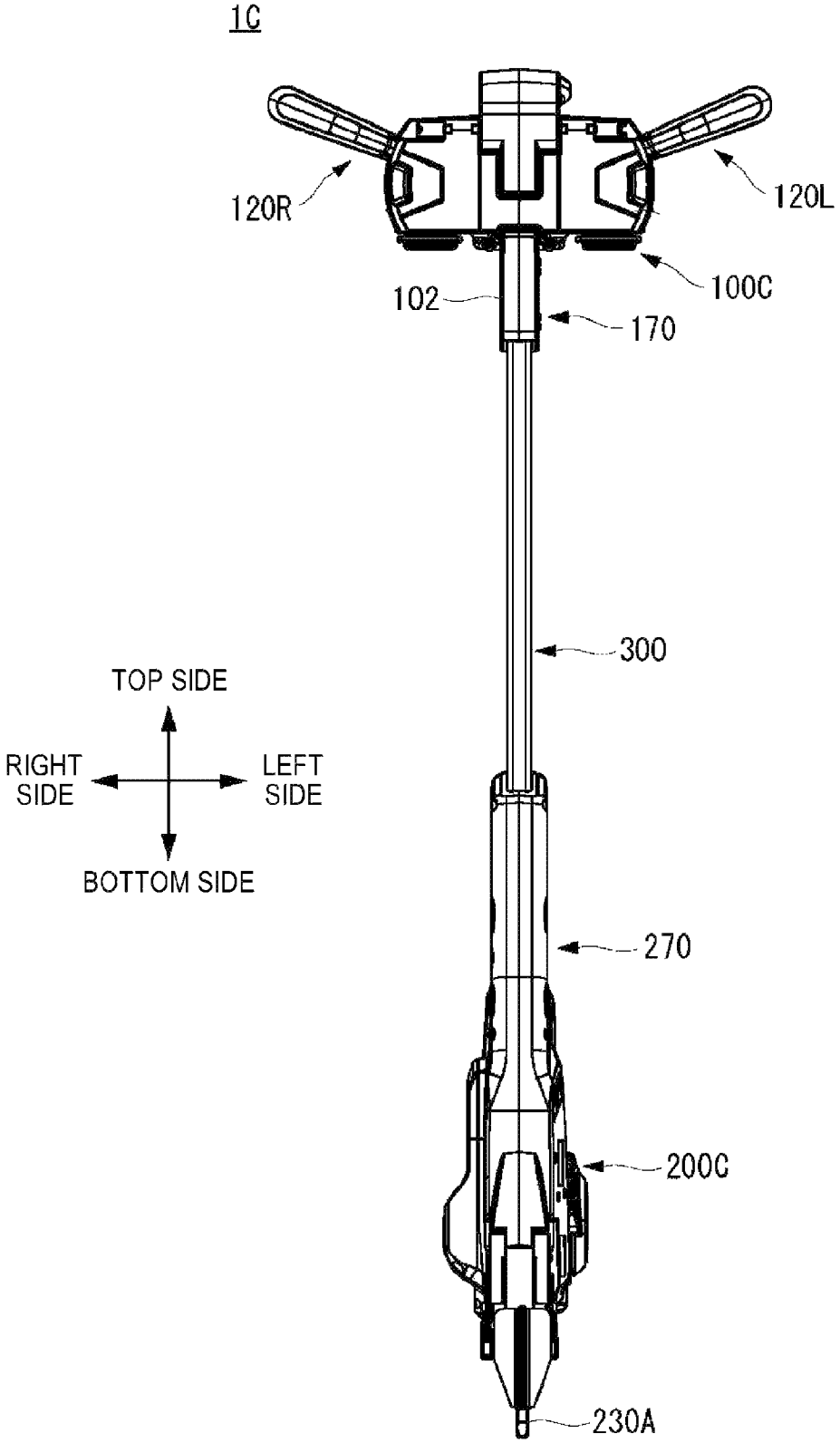
FIG. 10 is a front view depicting the external configuration of the reinforcing bar binding machine of the third embodiment.
Figure 11:
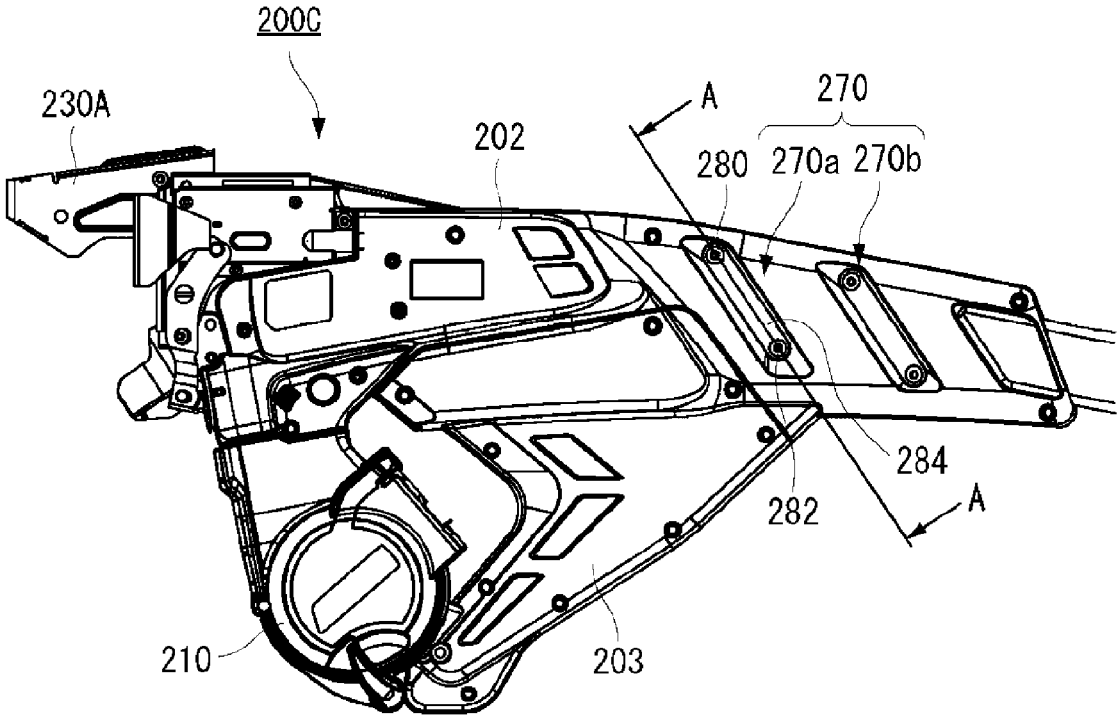
FIG. 11 is a side view depicting a second body part of the reinforcing bar binding machine of the third embodiment.
Figure 12A:
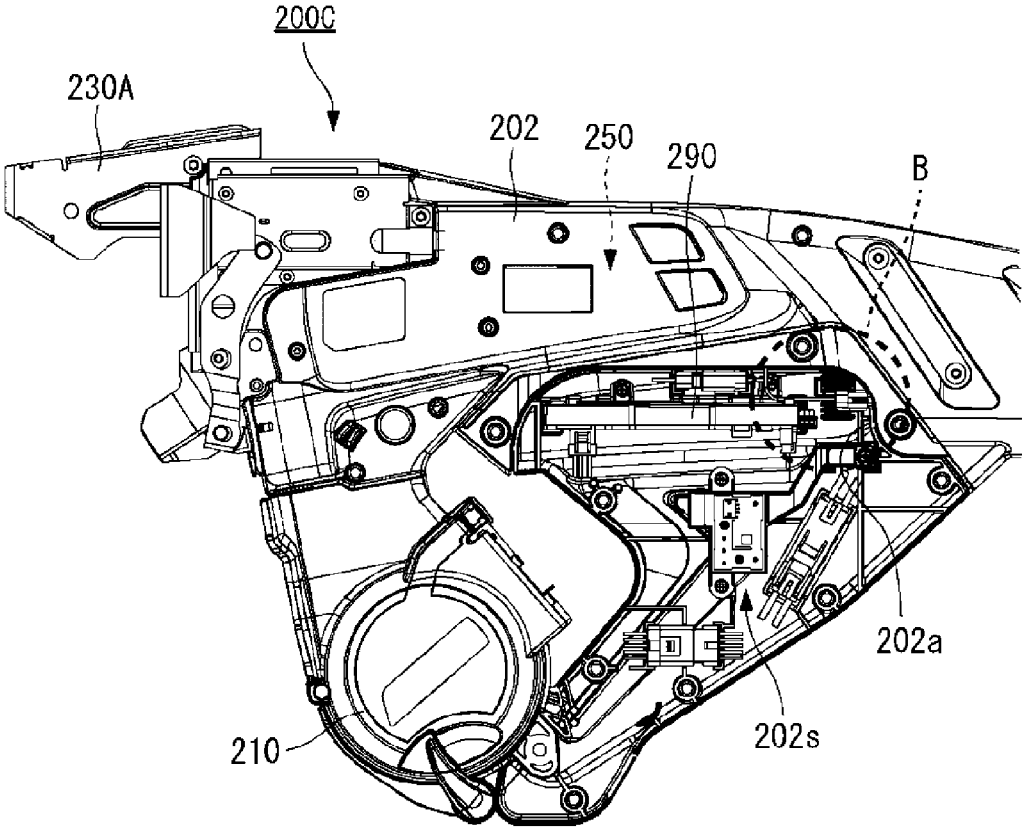
FIG. 12A is a side view depicting a state in which a cover part is detached from the second body part of the reinforcing bar binding machine of the third embodiment.
Figure 12B:
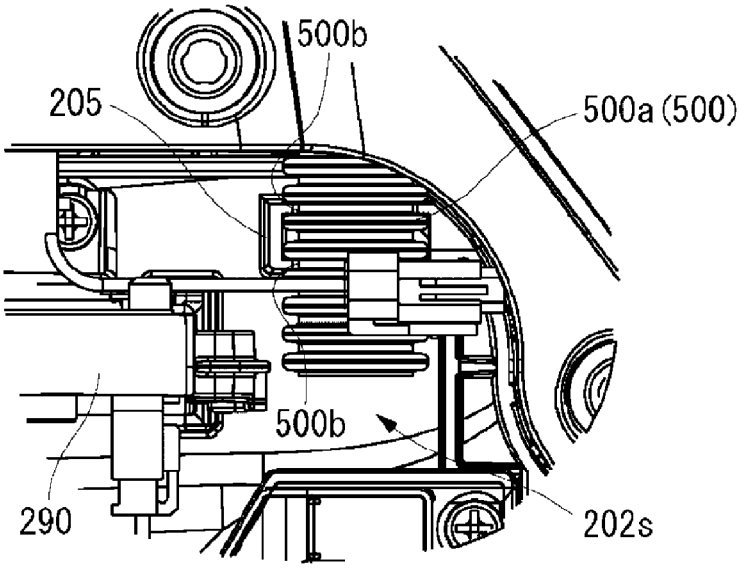
FIG. 12B is an enlarged view of a main part B of the second body part shown in FIG. 12A.
Figure 13:
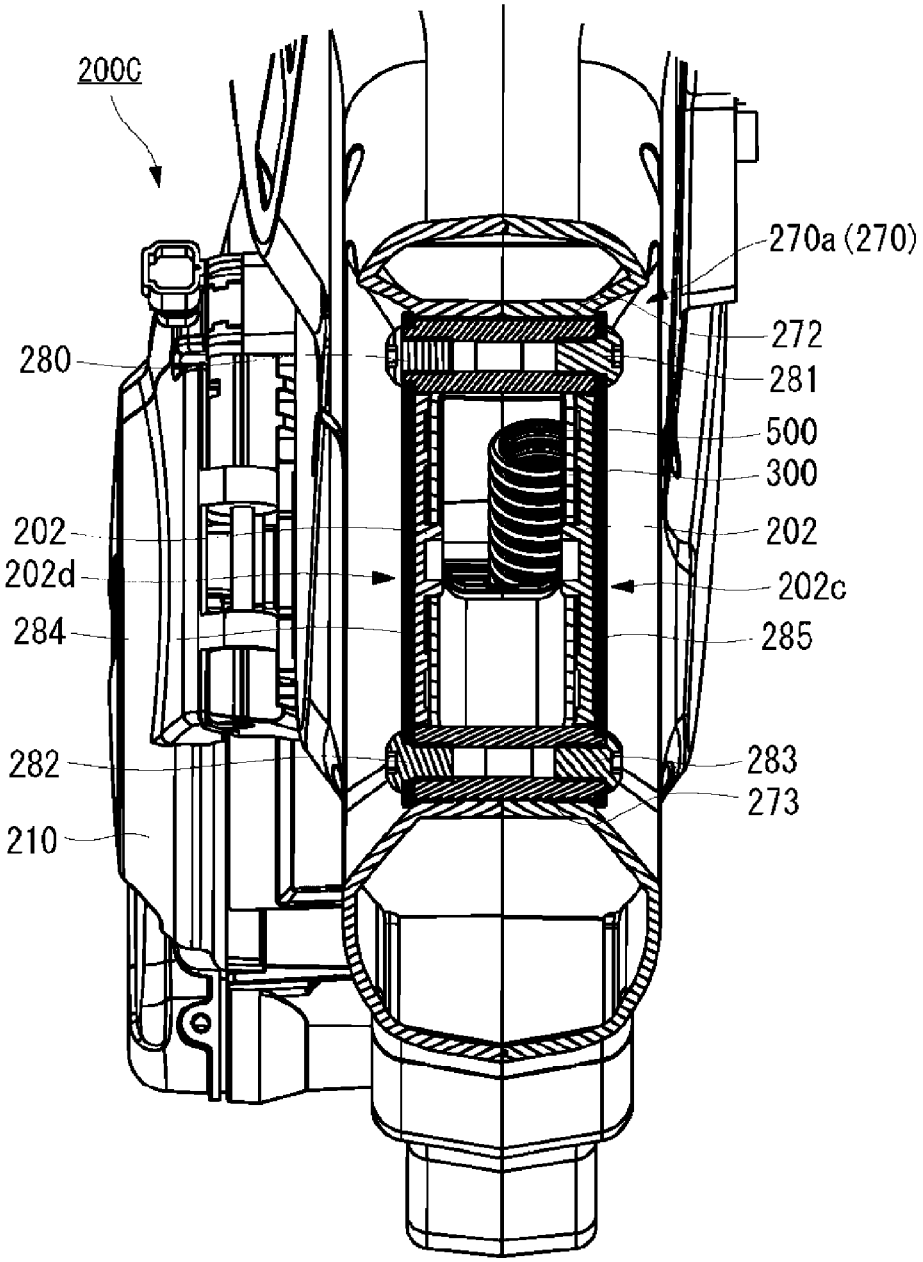
FIG. 13 is a sectional view taken along a line A-A of the reinforcing bar binding machine shown in FIG. 11.
Figure 14:
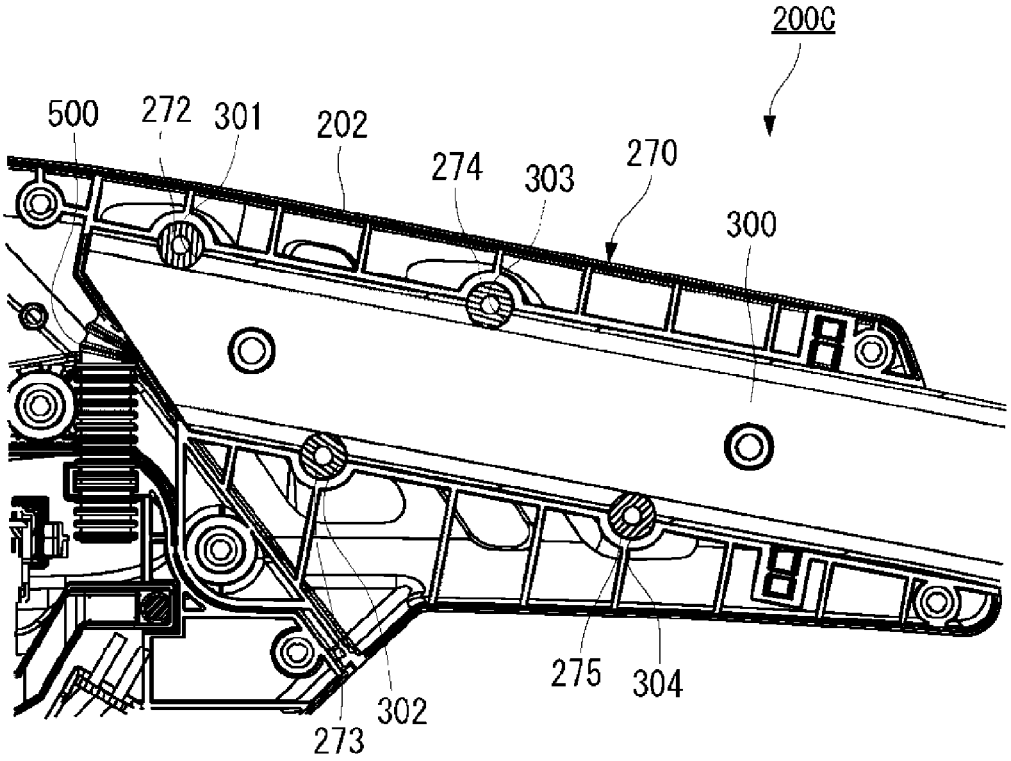
FIG. 14 is a sectional view of a fixing mechanism on the second body part-side of the reinforcing bar binding machine of the third embodiment.

FIG. 9 is a side view depicting an external configuration of the reinforcing bar binding machine 1C of the third embodiment, FIG. 10 is a front view depicting the external configuration of the reinforcing bar binding machine 1C of the third embodiment, FIG. 11 is a side view depicting a second body part 200C of the reinforcing bar binding machine 1C of the third embodiment, FIG. 12A is a side view depicting a state in which a cover part 203 is detached from the second body part 200C of the reinforcing bar binding machine 1C of the third embodiment, FIG. 12B is an enlarged view of a main part B of the second body part 200C shown in FIG. 12A, FIG. 13 is a sectional view taken along a line A-A of the reinforcing bar binding machine 1C shown in FIG. 11, and FIG. 14 is a sectional view of a second fixing mechanism 270 of the reinforcing bar binding machine 1C of the third embodiment.

The reinforcing bar binding machine 1C includes a first body part 100C, a second body part 200C having a curl guide 230A having an opening in which a binding object can be inserted and configured to curl the wire W around the binding object along a circumference of the binding object inserted in the opening and a twisting unit 250 (refer to FIG. 1) configured to twist the wire curled by the curl guide 230A, and a connecting part 300 configured to connect the first body part 100C and the second body part 200C each other.

As shown in FIGS. 11 and 12A, the second body part 200C has a second housing 202 which a wire feeding unit 220, the twisting unit 250, and an electric component including a substrate 290 are accommodated therein and has an opening 202*a* for exposing the electric component such as the substrate 290, and a cover part 203 for covering the opening 202*a* of the second housing 202. The substrate 290 and the like are accommodated in a space part 202*s* provided on a side closer to an operator-side than the twisting unit 250 in the second housing 202 and above the reel accommodation part 210. On the substrate 290, for example, a drive circuit configured to drive the twisting motor 251 (refer to FIG. 1), a drive circuit configured to drive a motor of the wire feeding unit 220 (refer to FIG. 1), and the like are mounted. The opening 202*a* is provided on a left surface of the second housing 202, for example. The cover part 203 is detachably attached to the second housing 202, thereby opening and closing the opening 202*a*. Thereby, the electric component such as the substrate 290 can be simply exposed from the second housing 202 without releasing an attached state of the second housing 202.

As shown in FIGS. 9, 12A, 12B and 13, a bellows-shaped tube 500 having an uneven surface is laid in the connecting part 300. The tube 500 is arranged in the connecting part 300, and is provided between the first body part 100C and the second body part 200C. In the tube 500, a wiring (not shown) for transmitting a signal and the like between the first body part 100C and the second body part 200C is arranged.

As shown in FIG. 12B, a lower end portion 500*a* of the tube 500 extends to the space part 202*s* within the second body part 200C, in which the substrate 290 is accommodated. The space part 202*s* is provided with a substantially U-shaped regulation part 205 having a convex portion, as seen from above. The regulation part 205 is fitted to a concave portion 500*b* of the lower end portion 500*a* of the tube 500, thereby fixing a position of the lower end portion 500*a* of the tube 500. Note that, the regulation part 205 may be constituted by a member having a concave shape and may be fitted with the convex portion of the tube 500, thereby fixing a position of the tube 500.

As shown in FIGS. 9, 11, 13 and 14, the second body part 200C includes a second fixing mechanism 270 having a first fixing part 270*a* to which a first shaft 272 and a second shaft 273, which are an example of the engaging part penetrating the second body part 200C, are provided and a second fixing part 270*b* to which a third shaft 274 and a fourth shaft 275, which are an example of the engaging part penetrating the second body part 200C, are provided. The second fixing mechanism 270 is provided on a base end-side (top side) of the second body part 200C, and fixes a lower end portion of the connecting part 300 to the second housing 202.

Before describing a configuration of the second fixing mechanism 270 on the second body part 200-side, for the sake of convenience, a configuration of the connecting part 300-side fixed to the second fixing mechanism 270 is described. As shown in FIG. 14, the connecting part 300 has a plurality of notched portions on one end-side (lower end portion) in a longitudinal direction and at each of end portions in a lateral direction. Specifically, a first notched portion 301 having a concave shape to which the first shaft 272 is fitted and a third notched portion 303 having a concave shape to which the third shaft 274 is fitted are each formed on the front surface-side of the lower end portion of the connecting part 300. A second notched portion 302 having a concave shape to which the second shaft 273 is fitted and a fourth notched portion 304 having a concave shape to which the fourth shaft 275 is fitted are each formed on the operator-side of the lower end portion of the connecting part 300.

Subsequently, a configuration of the first fixing part 270*a* of the second fixing mechanism 270 is described. As shown in FIGS. 13 and 14, the first shaft 272 and the second shaft 273 are each constituted by a shaft body having a length capable of penetrating the second housing 202 in the right and left direction. The first shaft 272 and the second shaft 273 are each attached at base end portions thereof to an elongated second plate 285 with a prescribed gap. The first shaft 272 and second shaft 273 and the second plate 285 are connected by a bolt 281 and a bolt 283. However, the first shaft 272, the second shaft 273 and the second plate 285 may also be constituted by an integrated component.

The second plate 285 is arranged in a concave portion 202*c* on the right side surface of the second housing 202. The first shaft 272 and the second shaft 273 attached to the second plate 285 are inserted from the right side surface of the second housing 202 and penetrate an inside of the second housing 202. At this time, as shown in FIG. 14, the first shaft 272 is fitted to the first notched portion 301 of the connecting part 300, and the second shaft 273 is fitted to the second notched portion 302 of the connecting part 300.

A first plate 284 is arranged in a concave portion 202*d* of the left side surface of the second housing 202 so as to press tip end portions of the first shaft 272 and the second shaft 273 projecting from the left side surface of the second housing 202. In this way, in a state where the second housing 202 is sandwiched by the pair of the first plate 284 and the second plate 285, a bolt 280 is screwed to the tip end portion of the first shaft 272, and a bolt 281 is screwed to the base end portion of the first shaft 272. Similarly, a bolt 282 is screwed to the tip end portion of the second shaft 273, and a bolt 283 is screwed to the base end portion of the second shaft 273.

Also for the second fixing part 270*b*, similarly to the first fixing part 270*a*, as shown in FIG. 14, the third shaft 274 and the fourth shaft 275 are inserted from the right side surface of the second housing 202, and the third shaft 274 is fitted to the third notched portion 303 of the connecting part 300 and the fourth shaft 275 is fitted to the fourth notched portion 304 of the connecting part 300. In the state where the second housing 202 is sandwiched by the pair of plates, bolts (not shown) are screwed to each of the third shaft 274 and the fourth shaft 275. Note that, since the configuration of the second fixing part 270*b* is similar to the first fixing part 270*a*, the detailed descriptions thereof are omitted.

Figure 15:
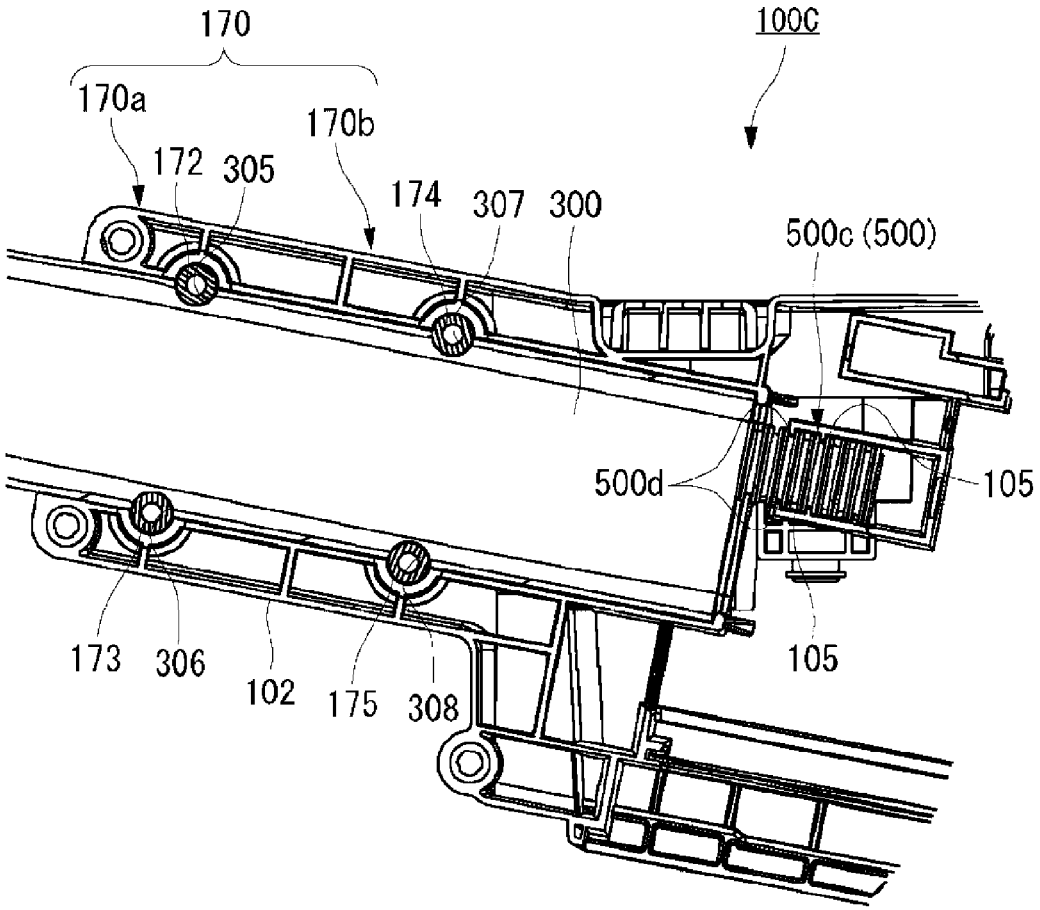
FIG. 15 is a sectional view of a fixing mechanism on a first body part-side of the reinforcing bar binding machine of the third embodiment.

In the third embodiment, the first fixing mechanism 170 having a similar configuration to the second fixing mechanism 270 configured to connect the second body part 200C and the connecting part 300 each other is provided to the first body part 100C. FIG. 15 is a sectional view of the fixing mechanism 170 on the first body part 100C-side of the reinforcing bar binding machine of the third embodiment.

As shown in FIGS. 9 and 15, the first body part 100C includes the first fixing mechanism 170 having a first fixing part 170*a* to which a fifth shaft 172 and a sixth shaft 173, which are an example of the engaging part penetrating the first body part 100C, are provided and a second fixing part 170*b* to which a seventh shaft 174 and an eighth shaft 175, which are an example of the engaging part penetrating the first body part 100C, are provided. The first fixing mechanism 170 is provided on a base end-side (top side) of the first body part 100C, and fixes a lower end portion of the connecting part 300 to the first housing 102.

Before describing a configuration of the first fixing mechanism 170 on the first body part 100C-side, for the sake of convenience, a configuration of the connecting part 300 fixed to the first fixing mechanism 170 is described. As shown in FIG. 15, the connecting part 300 has a fifth notched portion 305 having a concave shape to which the fifth shaft 172 is fitted and a seventh notched portion 307 having a concave shape to which the seventh shaft 174 is fitted on the other end-side (upper end portion) in the longitudinal direction and at the end portion on the front surface-side in the lateral direction. The connecting part 300 also has a sixth notched portion 306 having a concave shape to which the sixth shaft 173 is fitted and an eighth notched portion 308 having a concave shape to which the eighth shaft 175 is fitted on the other end-side in the longitudinal direction and at the end portion on the operator-side in the lateral direction.

Subsequently, a configuration of the first fixing mechanism 170 is described. The fifth shaft 172 and the sixth shaft 173 of the first fixing part 170*a* penetrate an inside of the first housing 102 in the right and left direction. As shown in FIG. 15, the fifth shaft 172 is fitted to the fifth notched portion 305 of the connecting part 300, and the sixth shaft 173 is fitted to the sixth notched portion 306 of the connecting part 300. Also as for the second fixing part 170*b*, similarly, the seventh shaft 174 and the eighth shaft 175 penetrate the inside of the first housing 102 in the right and left direction, and as shown in FIG. 15, the seventh shaft 174 is fitted to the seventh notched portion 307 of the connecting part 300, and the eighth shaft 175 is fitted to the eighth notched portion 308 of the connecting part 300. Note that, similarly to the second fixing mechanism 270 on the second body part 200C-side, the first housing 102 may be sandwiched by a pair of plates, and bolts may be each screwed to end portions of the shafts such as the fifth shaft 172. In this way, also on the first body part 100C-side, the first body part 100C and the connecting part 300 can be firmly connected by the first fixing mechanism 170.

As shown in FIG. 15, an upper end portion 500*c* of the tube 500 extends to an inside of the first body part 100C. In the first body part 100C, a regulation part 105 having a convex portion is provided. The regulation part 105 is fitted to a concave portion 500*d* of the upper end portion 500*c* of the tube 500, thereby fixing a position of the upper end portion 500*c* of the tube 500. Note that, the regulation part 105 may be constituted by a member having a concave shape and may be fitted with the convex portion of the tube 500, thereby fixing a position of the tube 500.

As described above, according to the third embodiment, when the cover part 203 is detached from the second housing 202 in which the electric component such as the substrate 290 is accommodated, the electric component in the second housing 202 can be exposed. Thereby, it is possible to efficiently perform the operation because it is possible to perform an operation on the electric component without detaching the second housing 202 in which the twisting unit 250 and the like are accommodated.

In addition, according to the third embodiment, the regulation part 205 is fitted to the concave portion 500*b* of the tube 500, so that the lower end portion 500*a* of the tube 500 can be fixed to a predetermined position in the second housing 202. Therefore, even when a force is applied in a pulling direction upon attaching of the reinforcing bar binding machine 1A or vibrations occur during a striking operation, the lower end portion 500*a* of the tube 500 can be prevented from coming off from the second housing 202. In addition, the wiring is enabled to pass through the inside of the tube 500, so that it is possible to secure double insulation for the wiring.

Further, according to the third embodiment, since the second body part 200C is provided with the second fixing mechanism 270 configured to connect the second housing 202 and the connecting part 300 each other, and is fitted to the first notched portion 301 and the like of the connecting part 300 by the first shaft 272 and the like penetrating the second housing 202, it is possible to firmly connect the second housing 202 and the connecting part 300 each other. Thereby, it is possible to secure connection strength of the second housing 202 and the connecting part 300, and for example, even when the force in the pulling direction is applied to the connecting part 300, the connecting part 300 can be prevented from coming off from the second body part 200C.

In addition, according to the third embodiment, since the first body part 100C is provided with the first fixing mechanism 170 configured to connect the first housing 102 and the connecting part 300 each other, and is fitted to the fifth notched portion 305 and the like of the connecting part 300 by the fifth shaft 172 and the like penetrating the first housing 102, it is possible to firmly connect the first housing 102 and the connecting part 300 each other. Thereby, it is possible to secure connection strength of the first housing 102 and the connecting part 300, and for example, even when the force in the pulling direction is applied to the connecting part 300, the connecting part 300 can be prevented from coming off from the first body part 100C.

Note that, the technical scope of the present disclosure is not limited to the above embodiments, and includes a variety of changes made to the above embodiments without departing from the gist of the present disclosure.

For example, in the first and second embodiments, the connecting part 300 is constituted by the linear member. However, the connecting part 300 is not necessarily required to be linear as long as it can position vertically or substantially vertically the twisting shaft 253 with respect to the reinforcing bars S ahead of the foot, in other words, it can enable the curl guide 230A, 230B to be inserted from immediately above or substantially immediately above the reinforcing bars S. For example, the connecting part may be bent or curved. However, even when the connecting part 300 is not linear, it is required that at least the virtual axis line A1 be inclined relative to the axis line A2 of the twisting shaft 253. Also, when the connecting part 300 is bent or curved, the axis line A3 of the connecting part 300 is a virtual axis line connecting a connection part of the upper end of the connecting part 300 and the first body part 100 and a connection part of the lower end of the connecting part 300 and the second body part 200.

In addition, in the reinforcing bar binding machines 1A and 1B of the first and second embodiments, the grips 120R and 120L are provided on respective both sides of the axis line A3 of the connecting part 300, as seen from the operator-side, and are held with both hands. However, the present disclosure is not limited thereto. For example, in the reinforcing bar binding machines 1A and 1B, a single grip may be configured and may be held with one hand.

<Additional Statements>

The present technology can also adopt following configurations.

(1) A binding machine including:

a first body part;

a second body part having a housing, a curl guide attached to the housing, and a twisting unit arranged in the housing, the curl guide having an opening in which a binding object can be inserted and being configured to curl a wire around the binding object inserted in the opening, and the twisting unit including a twisting shaft for twisting the curled wire; and an elongated connecting part connecting the first body part and the second body part, wherein the curl guide includes first and second guide parts projecting in a first direction from a tip end of the housing and arranged with a prescribed gap to define the opening in a second direction orthogonal to the first direction, wherein the second body part includes:

a housing in which the twisting unit and a substrate configured to drive the twisting unit are accommodated, the housing having an opening for exposing the substrate, and a cover part configured to cover the substrate exposed from the housing, and wherein the cover part is detachably mounted to the housing.

(2) The binding machine according to the above (1), wherein a wiring for transmitting a signal between the first body part and the second body part is provided in the connecting part.

(3) The binding machine according to the above (2), further including a tube through which the wiring passes, wherein the tube is provided between the first body part and the second body part via the connecting part.

(4) The binding machine according to the above (3), wherein the tube has a concave portion on a surface thereof, and wherein the second body part has a convex portion that can be fitted to the concave portion of the tube.

(5) The binding machine according to the above (3), wherein the tube has a convex portion on a surface thereof, and wherein the second body part has a concave portion that can be fitted to the convex portion of the tube.

(6) The binding machine according to any one of the above (1) to (5), wherein the first body part and the second body part are arranged such that a virtual axis line, which connects an intermediate position in the prescribed gap at a tip end of the second body part and an intermediate position in a lateral direction of the connecting part at a connection end of the connecting part with the first body part, is inclined relative to an axis line of the twisting shaft.

The subject application is based on Japanese Patent Application Nos. 2018-168250 filed on Sep. 7, 2018 and 2019-156059 filed on Aug. 28, 2019, the contents of which are incorporated herein by reference.

REFERENCE SIGNS LIST

1A, 1B, 1C: reinforcing bar binding machine (binding machine)
100, 100C: first body part
102: first housing
120R, 120L: grip
140: battery mounting part
142: battery
170: first fixing mechanism
172: fifth shaft (engaging part)
173: sixth shaft (engaging part)
174: seventh shaft (engaging part)
175: eighth shaft (engaging part)
200, 200C: second body part
202: second housing (housing)
220: wire feeding unit
230A, 230B: curl guide
231A: first guide part
232A: second guide part
250: twisting unit
253: twisting shaft
270: second fixing mechanism
272: first shaft (engaging part)
273: second shaft (engaging part)
274: third shaft (engaging part)
275: fourth shaft (engaging part)

300: connecting part
301: first notched portion
302: second notched portion
303: third notched portion
304: fourth notched portion
305: fifth notched portion
306: sixth notched portion
307: seventh notched portion
308: eighth notched portion
A1: virtual axis line
A2: axis line of twisting shaft
A3: axis line of connecting part
S: reinforcing bar (binding object)
W: wire

The invention claimed is:

1. A binding machine comprising:

a first body part having a battery mounting part that mounts a battery;

a second body part having a housing, a curl guide attached to the housing, and a twisting unit arranged in the housing, the curl guide having an opening in which a binding object arranged on a surface can be inserted and the curl guide curls a wire around the binding object inserted in the opening, and the twisting unit including a twisting motor and a twisting shaft for twisting the curled wire; and an elongated connecting part connecting the first body part at a first connection end and the second body part at a second connection end;

wherein the connecting part is an elongated hollow member and a wiring extends inside thereof, and power is supplied from the first body part to the second body part through the wiring, wherein the curl guide includes first and second guide parts projecting in a first direction from a tip end of the second body part and arranged with a prescribed gap to define the opening in a second direction orthogonal to the first direction, wherein the first body part and the second body part are arranged such that a virtual axis line connects (i) a first intermediate position in the prescribed gap at the tip end of the second body part with (ii) a second intermediate position in a lateral direction of the elongated connecting part at the first connection end of the elongated connecting part, wherein, in a state in which an axis line of the twisting shaft is orthogonal to the surface on which the binding object is arranged such that the binding object is inserted in the opening:

the virtual axis line is inclined relative to the axis line of the twisting shaft such that the virtual axis line is inclined farther towards a first side of the binding machine in the second direction than the axis line of the twisting shaft.

2. The binding machine according to claim 1, wherein the first body part has at least one grip that can be grasped by an operator.

3. The binding machine according to claim 2, wherein the at least one grip is arranged such that an axis line of the at least one grip is orthogonal to the axis line of the twisting shaft.

4. The binding machine according to claim 2, wherein the elongated connecting part is arranged such that an axis line of the elongated connecting part is inclined toward the first side of the binding machine in the second direction with respect to the axis line of the twisting shaft.

5. The binding machine according to claim 4, wherein an inclination angle of the axis line of the elongated connecting part with respect to the axis line of the twisting shaft is equal to or smaller than 45 degrees.

6. The binding machine according to claim 4, wherein the elongated connecting part is attached to the second body part such that an inclination angle with respect to the axis line of the twisting shaft can be changed.

7. The binding machine according to claim 1, wherein the elongated connecting part is detachably mounted to the second body part.

8. The binding machine according to claim 2, wherein the at least one grip includes two grips, and the two grips are arranged on respective sides of the axis line of the twisting shaft.

9. The binding machine according to claim 1, wherein the elongated connecting part has a notched portion on the second connection end, wherein the second body part includes a second fixing mechanism having an engaging part, and wherein in a state where the second connection end is inserted in the second body part, the engaging part of the second fixing mechanism is fitted into the notched portion of the second connection end.

10. The binding machine according to claim 1, wherein the elongated connecting part has a notched portion on the first connection end, wherein the first body part includes a first fixing mechanism having an engaging part, and wherein in a state where the first connection end is inserted in the first body part, the engaging part of the first fixing mechanism is fitted into the notched portion of the first connection end.

11. The binding machine according to claim 1, further comprising a setting unit that sets one or more operation conditions of the binding machine, the setting unit positioned on the first body part, wherein the one or more operating conditions includes at least one of a number of turns of the wire and a twisting torque for the wire.

12. The binding machine according to claim 2, wherein the at least one grip extends in the second direction such that the at least one grip can be grasped by the operator on the first side of the binding machine.

13. The binding machine according to claim 1, further including:

a reel accommodation part configured to accommodate a wire reel, the reel accommodation part positioned on the second body part, wherein the reel accommodation part is positioned on the first side of the binding machine, and the reel accommodation part is offset with respect to the curl guide on the first side of the binding machine in the second direction.

* * * * *